US011421181B2

(12) United States Patent
Mayrhofer et al.

(10) Patent No.: US 11,421,181 B2
(45) Date of Patent: Aug. 23, 2022

(54) ENVIRONMENTALLY FRIENDLY LUBRICATING GREASE FOR STEEL ROPES

(71) Applicant: Klueber Lubrication Muenchen SE & Co. KG, Munich (DE)

(72) Inventors: Brigitte Mayrhofer, Munich (DE); Maximilian Erhard, Poecking (DE); Patrick Wittmeyer, Gerertsried (DE); Stefan Seemeyer, Wolfratshausen (DE)

(73) Assignee: KLUEBER LUBRICATION MUENCHEN SE & CO. KG, Munich (DE)

( * ) Notice: Subject to any disclaimer, the term of this patent is extended or adjusted under 35 U.S.C. 154(b) by 0 days.

(21) Appl. No.: 17/258,456

(22) PCT Filed: Jul. 9, 2019

(86) PCT No.: PCT/EP2019/068344
§ 371 (c)(1),
(2) Date: Jan. 7, 2021

(87) PCT Pub. No.: WO2020/011758
PCT Pub. Date: Jan. 16, 2020

(65) Prior Publication Data

US 2021/0277323 A1 Sep. 9, 2021

(30) Foreign Application Priority Data

Jul. 9, 2018 (DE) ..... 10 2018 005 397.1
Oct. 23, 2018 (DE) ..... 10 2018 008 362.5

(51) Int. Cl.

| | |
|---|---|
| ***C10M 169/00*** | (2006.01) |
| ***C10M 169/06*** | (2006.01) |
| ***C10M 107/32*** | (2006.01) |
| ***C10M 117/04*** | (2006.01) |
| ***C10M 125/10*** | (2006.01) |
| ***C10M 125/30*** | (2006.01) |
| ***C10M 143/06*** | (2006.01) |
| *C10N 30/00* | (2006.01) |
| *C10N 20/00* | (2006.01) |
| *C10N 10/04* | (2006.01) |
| *C10N 20/02* | (2006.01) |
| *C10N 30/08* | (2006.01) |
| *C10N 30/12* | (2006.01) |
| *C10N 40/32* | (2006.01) |
| *C10N 50/10* | (2006.01) |

(52) U.S. Cl.
CPC ..... *C10M 169/06* (2013.01); *C10M 107/32* (2013.01); *C10M 117/04* (2013.01); *C10M 125/10* (2013.01); *C10M 125/30* (2013.01); *C10M 143/06* (2013.01); *C10M 2201/062* (2013.01); *C10M 2201/065* (2013.01); *C10M 2205/026* (2013.01); *C10M 2207/281* (2013.01); *C10M 2209/1023* (2013.01); *C10N 2010/04* (2013.01); *C10N 2020/02* (2013.01); *C10N 2020/081* (2020.05); *C10N 2030/08* (2013.01); *C10N 2030/12* (2013.01); *C10N 2030/64* (2020.05); *C10N 2030/74* (2020.05); *C10N 2040/32* (2013.01); *C10N 2050/10* (2013.01)

(58) Field of Classification Search
CPC ..... C10M 169/06; C10M 107/32; C10M 125/30; C10M 117/04; C10M 125/10; C10M 2207/281; C10M 2201/065; C10M 2201/062; C10N 2050/10; C10N 2020/081; C10N 2040/32; C10N 2010/04; C10N 2030/64; C10N 2030/12
USPC ..... 508/136
See application file for complete search history.

(56) References Cited

U.S. PATENT DOCUMENTS

| | | | | |
|---|---|---|---|---|
| 4,486,319 | A | 12/1984 | Jamison | |
| 4,589,990 | A | 5/1986 | Zehler | |
| 5,783,528 | A * | 7/1998 | Rodenberg | C10M 105/06 508/200 |
| 6,010,985 | A | 1/2000 | Heimann | |
| 6,225,265 | B1 | 5/2001 | Shibuya | |

(Continued)

FOREIGN PATENT DOCUMENTS

| | | | |
|---|---|---|---|
| CA | 2364200 | A1 | 6/2003 |
| CH | 540331 | A | 8/1973 |

(Continued)

OTHER PUBLICATIONS

Albert, Ryan, "United States Environmental Protection Agency Office of Wastewater 1-10 Management Environmentally Acceptable Lubricants Contents," Nov. 2011, pp. 4-6, United States Environmental Protection Agency Office of Wastewater Management, Washington, DC, USA.

*Primary Examiner* — Prem C Singh
*Assistant Examiner* — Francis C Campanell
(74) *Attorney, Agent, or Firm* — Leydig, Voit & Mayer, Ltd.

(57) ABSTRACT

An environmentally acceptable lubricating grease, comprising: a) 50 wt % to 90 wt % of a biodegradable base oil comprising a biodegradable ester as base oil; b) 3 wt % to 25 wt % of a thickener selected from b1) 3 wt % to 12 wt % biodegradable calcium soap, b2) 3 wt % to 25 wt % bentonites, b3) and mixtures thereof; c) 4 wt % to 40 wt % additives, comprising c1) 1 wt % to 12 wt % fumed silicon dioxide and/or polytetrafluoroethylene and/or mixtures thereof, c2) 2 wt % to 45 wt % of a polymer selected from polyisobutylene, polyisobutylene/butene copolymer, polymethacrylates, polyesters and mixtures thereof, c3) 0.5 wt % to 20 wt % of a solid lubricant.

20 Claims, No Drawings

(56) References Cited

U.S. PATENT DOCUMENTS

| | | | | |
|---|---|---|---|---|
| 6,329,073 | B1 | 12/2001 | Deruyck | |
| 6,331,509 | B1 * | 12/2001 | Heimann | C10M 135/10 508/136 |
| 2014/0329731 | A1 | 11/2014 | Genet | |
| 2017/0233676 | A1 | 8/2017 | Bredsguard | |

FOREIGN PATENT DOCUMENTS

| | | | |
|---|---|---|---|
| CN | 102102047 | A | 6/2011 |
| CN | 102618371 | A | 8/2012 |
| CN | 102827678 | A | 12/2012 |
| DE | 102016011022 | A1 | 3/2017 |
| EP | 0108536 | A1 | 5/1984 |
| GB | 2553340 | A | 3/2018 |
| JP | H11332177 | A | 11/1999 |
| JP | 2015504933 | A | 2/2015 |

* cited by examiner

ENVIRONMENTALLY FRIENDLY LUBRICATING GREASE FOR STEEL ROPES

CROSS-REFERENCE TO RELATED APPLICATIONS

This application is a U.S. National Phase application under 35 U.S.C. § 371 of International Application No. PCT/EP2019/068344, filed on Jul. 9, 2019, and claims benefit to German Patent Application No. DE 10 2018 005 397.1, filed on Jul. 9, 2018, and German Patent Application No. DE 10 2018 008 362.5, filed on Oct. 23, 2018. The International Application was published in German on Jan. 16, 2020 as WO 2020/011758 under PCT Article 21(2).

BACKGROUND

Disclosed is an environmentally acceptable lubricating grease for steel ropes, in particular galvanized steel ropes. Also disclosed is a method for producing the lubricating grease and to the use thereof.

Lubricants for steel ropes are used to separate the individual rope tips from one another by a lubricating film, i.e. to lubricate them, and thereby to reduce wear, and also to protect the steel rope as a whole from corrosion. Depending on their respective field of application, the lubricants must also fulfill various additional tasks. For example, in the marine industry sector and in the oil and gas industries, it is necessary for the lubricants to exhibit both a good lubricating action and also to be usable in a wide temperature range and also in the presence of water. If galvanized steel ropes are used, the lubricants must furthermore have no negative influence on the zinc layer of the steel rope.

In addition, there is in principle an increasing demand for environmentally acceptable lubricants, in particular lubricants which meet the requirements for environmentally acceptable lubricants (EAL) according to Appendix A of the 2013 Vessel General Permit and can therefore also be used for components which may come into contact with seawater. Environmentally acceptable lubricants must be biodegradable and must have only minimal toxicity as well as no bioaccumulability.

A wide variety of lubricants for steel ropes are described in the literature.

CH 540331 A describes a lubricant for steel ropes which contains as main component a saturated or unsaturated fatty acid having 5-30 C atoms or an ester of such an acid or a mixture thereof.

EP 0108536 A1 describes a corrosion preventive composition comprising a corrosion inhibitor, a thickener and a thixotropic gel. The corrosion preventive composition can be used for the treatment of multi-wire electrical conductors, wire ropes or cables.

U.S. Pat. No. 4,589,990 A describes a lubricant composition containing specific synthetic esters, namely polyol esters, trimellitate esters and polymeric fatty acid esters, and a mixture of polyisobutylene polymers having different molecular weights. The lubricant composition can also be used inter alia for the treatment of wire ropes.

U.S. Pat. No. 4,486,319 A describes a microporous lubricating composition containing an ionomer polymer and a liquid lubricant. The ionomer polymer may be combined with other polymers, and the composition may contain various additives in order to modify the performance and properties of the resulting composition. The formed composition can be used for lubricating mechanical components including wire ropes and bearings, such as sliding bearings.

CA 2364200 describes a lubricating composition for lubricating wire ropes comprising: (a) between 50 and 95 percent by volume of a base liquid; (b) between 1 and 8 percent by volume of a lubricant with a low acid content; (c) between 0.2 and 5.0 percent by volume of a low acidity corrosion inhibitor; (d) between 0.1 and 10 percent by volume of an extreme pressure agent; and (e) between 0.1 and 10 percent by volume of an anti-wear agent.

U.S. Pat. No. 6,329,073 B1 describes a steel object treated with a corrosion-inhibiting and adhesion-retaining composition, the composition comprising: A) an oily or waxy carrier as carrier of active components and B) active components, comprising: B1) a corrosion inhibitor in the form of a sulfonate of group IIA; B2) a co-corrosion inhibitor selected from the group consisting of: (a) one or more fatty acids having 6 to 24 carbon atoms, aromatic acids and naphthenic acids, the acids having the free acid form or the salt form; (b) one or more imidazoline derivatives having a C6-24 alkyl unit; and (c) one or more of C6-24 alkylsuccinic anhydride compounds; and (d) mixtures of one or more of the compounds defined under (a), (b) and (c) or mixtures of multiple forms of the compounds defined under (a), (b) and (c); and C) optionally a compound selected from the group consisting of: C1) a water repellent; C2) a synthetic ester derived from a C1-10 alcohol having 1-12 hydroxyl groups and C6-24 fatty acids; and C3) a C6-18 alcohol; and C4) a mixture of one or more of the compounds defined under C1), C2) and C3) or mixtures of multiple forms of the compounds defined under C1), C2), and C3), the elongated steel object being a hard-drawn steel wire.

U.S. Pat. No. 6,010,985 A describes a nontoxic lubricant, grease or gel composition comprising a combination of: at least one base oil from about 45 to about 90 wt %; at least one polymer from about 10 to about 20 wt % that is at least partially miscible with the at least one base oil; and about 1 to about 50 wt % of at least one silicate thickener comprising at least one compound selected from the group consisting of aluminum silicate, magnesium silicate, sodium silicate, calcium silicate, potassium silicate, lithium silicate and ammonium silicate.

CN 102102047 A describes a protective grease composition for a high temperature resistant steel wire rope and a manufacturing method thereof. The lubricating grease composition is prepared from base oil (high viscosity mineral oil or synthetic oil), a thickener, an additive and a covering agent. The lubricating grease for the steel wire rope is produced by thickening the base oil with a solid hydrocarbon thickener. The thickener is bentonite. A high molecular weight tackifier and a lubricating grease are used as solid filler in order to improve the performance, the high-temperature resistance and the adhesive strength of bentonite lubricating grease. The protective grease for the steel wire rope is especially used for protecting steel wire ropes in an extreme high-temperature environment.

CN 102618371 A describes steel rope grease with a high dropping point and a method for preparing the steel rope grease. The steel rope grease consists of the following components (in percentages by weight): 65%-85% base oil, 5%-20% thickener, 2%-15% adhesive, 1%-6% rust preventive agent, 0-5% antioxidant, 0-5% polar additive and 0.5%-6% solid lubricant.

CN 102827678 A describes a wire rope lubricating grease composition which, in addition to lubrication, also provides corrosion protection. The composition consists of the following components: 51.0% to 72.5% of calcium sulfonate composite grease no. 2, 25.0 to 38.0% of base oil, 0.2 to 1.0% of diphenylamine, 1.3 to 5.5% of colloidal graphite and 1.0 to 4.5% of ozokerite. The product is suitable for lubricating and protecting various wire ropes under oceanic climatic conditions such as seaports, maritime vessels, offshore drilling platforms, etc.

However, the above-mentioned lubricants do not meet all of the above-mentioned requirements, namely in addition to a good lubricating action being usable in a wide temperature range and also in the presence of water and also meeting the requirements for environmentally acceptable lubricants (EAL) according to Appendix A of the 2013 Vessel General Permit.

SUMMARY

In an embodiment, disclosed is an environmentally acceptable lubricating grease, comprising: a) 50 wt % to 90 wt % of a biodegradable base oil comprising a biodegradable ester as base oil; b) 3 wt % to 25 wt % of a thickener selected from b1) 3 wt % to 12 wt % biodegradable calcium soap, b2) 3 wt % to 25 wt % bentonites, b3) and mixtures thereof; c) 4 wt % to 40 wt % additives, comprising c1) 1 wt % to 12 wt % fumed silicon dioxide and/or polytetrafluoroethylene and/or mixtures thereof, c2) 2 wt % to 45 wt % of a polymer selected from polyisobutylene, polyisobutylene/butene copolymer, polymethacrylates, polyesters and mixtures thereof, c3) 0.5 wt % to 20 wt % of a solid lubricant.

In an embodiment, disclosed herein is a method comprising coating steel ropes with an environmentally acceptable lubricating grease, comprising: a) 50 wt % to 90 wt % of a biodegradable base oil comprising a biodegradable ester as base oil; b) 3 wt % to 25 wt % of a thickener selected from b1) 3 wt % to 12 wt % biodegradable calcium soap, b2) 3 wt % to 25 wt % bentonites, b3) and mixtures thereof; c) 4 wt % to 40 wt % additives, comprising c1) 1 wt % to 12 wt % fumed silicon dioxide and/or polytetrafluoroethylene and/or mixtures thereof, c2) 2 wt % to 45 wt % of a polymer selected from polyisobutylene, polyisobutylene/butene copolymer, polymethacrylates, polyesters and mixtures thereof, c3) 0.5 wt % to 20 wt % of a solid lubricant.

DETAILED DESCRIPTION

In an embodiment, a lubricant is disclosed which meets the above-mentioned requirements.

In an embodiment, disclosed is an environmentally acceptable lubricating grease, comprising:

a) 50 wt % to 90 wt % of a biodegradable base oil, in particular a biodegradable ester as base oil, b) 3 wt % to 25 wt % and/or 7 wt % to 20 wt % of a thickener selected from
   - b1) 3 wt % to 12 wt % biodegradable calcium soap,
   - b2) 3 wt % to 25 wt % and/or 3.5 wt % to 20 wt % and/or 4 wt % to 12 wt % bentonites,
   - b3) and mixtures thereof, c) 4 wt % to 40 wt %, preferably 7 wt % to 40 wt % additives, comprising
   - c1) 1 wt % to 12 wt % and/or 4 wt % to 12 wt % fumed silicon dioxide and/or polytetrafluoroethylene and mixtures thereof,
   - c2) 2 wt % to 45 wt % and/or 2 wt % to 25 wt % of a polymer selected from polyisobutylene, polyisobutylene/butene copolymer, polymethacrylates, polyesters, preferably complex esters, in particular complex esters of neopentyl glycol/dimer acid/2-ethylhexanol and mixtures thereof,
   - c3) 0.5 wt % to 20 wt % and/or 1 wt % to 10 wt % of a solid lubricant.

In extensive experiments, it was found by the applicant that with a lubricating grease of the above-mentioned composition it is possible to provide an environmentally acceptable lubricant which combines outstanding lubricating properties when applied to steel ropes, in particular galvanized steel ropes, with an applicability even in the presence of water and in a wide temperature range.

Thus, in an embodiment, the lubricating grease has a dropping point according to standard DIN ISO 2176 of over 150° C., for example 150° C. to 300° C. and/or 170° C. to 300° C. and/or 200° C. to 290° C. In a further embodiment, the lubricating grease has an upper operating temperature (UOT) according to standard DIN 58397, Part 1, of at least 150° C., for example 150° C. to 200° C. and/or 150° C.

In an embodiment, preferably at least 75 wt %, for example 75 wt % to 100 wt %, more preferably at least 80 wt %, for example 80 wt % to 100 wt % and/or 85 wt % to 100 wt % and/or 75 wt % to 90 wt % of the lubricating grease consists of biodegradable and nontoxic ingredients. The lubricating grease can also contain up to 25 wt % of non-biodegradable components, provided that they are not bioaccumulating and/or are only minimally toxic. Consequently, the lubricating grease in an embodiment meets the criteria for environmentally acceptable lubricants (EAL) according to Appendix A of the 2013 Vessel General Permit. Thus, the lubricating grease can also be used for applications that may come into contact with seawater.

Moreover, it has been found that components a) to c) have no negative influence on the zinc layer of galvanized steel ropes and, in particular, do not undergo any reaction with the zinc layer.

As component a), the lubricating grease contains at least 50 wt %, for example 50 wt % to 90 wt %, more preferably at least 60 wt %, for example 60 wt % to 80 wt %, and in particular 65 wt % to 75 wt % of a biodegradable base oil, in particular a biodegradable ester as base oil. The proportion of component a) is in each case based on the total amount of the lubricating grease.

A biodegradable base oil or a biodegradable ester is to be understood in an embodiment as a base oil and/or an ester which is biodegradable according to standard OECD 301 A-F or OECD 306.

In an embodiment, it is also possible to use mixtures of different base oils and/or different esters. In order for the lubricant to meet the requirements for EAL, the base oil and/or the ester must also have no toxicity.

In an embodiment, a plurality of biodegradable base oils and in particular of biodegradable esters can be used as component a), provided that they have sufficient thermal stability.

Preferred biodegradable base oils are base oils and in particular esters which have a thermal stability, determinable via TGA (DIN 51006; evaporation loss of greater than 1 wt % means thermally unstable) of over 150° C., for example in the range of 150° C. to 200° C.

The base oil and in particular the ester preferably also have a rather low volatility. Thus, preferred biodegradable base oils are base oils and in particular esters which have a volatility measured according to DIN 58397, after 7 d at 150° C., of <10 wt %, preferably <5 wt %.

The lubricating grease preferably likewise has a rather low volatility. Thus, preferred lubricating greases are lubricating greases which have a volatility measured according to DIN 58397, after 7 d at 150° C., of <10 wt %, preferably <5 wt %.

Furthermore, the base oil and in particular the ester preferably exhibit a high hydrolytic stability. For this reason, preferred biodegradable base oils are base oils and/or esters which have a TAN Delta (change in acid content), measured in accordance with DIN ASTM D-2619 (with extended running time of 400 h, 93° C.) of 0.0 mg KOH/g to 20, more preferably of 0.0 to 15 mg KOH/g.

Finally, the base oils and in particular the esters preferably exhibit a low acid content (TAN) in accordance with DIN EN 12634, with preferred biodegradable base oils and in particular esters having an acid content (TAN), of less than 5 mg KOH/g, for example 0.01 mg to 5 mg KOH/g, more preferably of less than 1 mg KOH/g, for example 0.01 mg KOH/g to 1 mg KOH/g.

The viscosity of the biodegradable base oil is preferably at least 18 $mm^2/s$, for example 18 $mm^2/s$ to 1200 $mm^2/s$ and/or at least 100 $mm^2/sec$, for example 100 $mm^2/sec$ to 1200 $mm^2/s$ and/or 120 to 500 $mm^2/sec$ and/or 120 to 300 $mm^2/sec$, in each case measured in accordance with DIN EN ISO 3104 at 40° C.

The viscosity of preferred mixtures of base oils measured in accordance with DIN 51562, Part 1, at 40° C. is at least 18 $mm^2/s$, for example 18 $mm^2/s$ to 1200 $mm^2/s$ and/or 18 $mm^2/s$ to 500 $mm^2/s$ and/or 18 to 200 $mm^2/s$.

The viscosity of preferred biodegradable esters is preferably at least 50 $mm^2/sec$, for example 50 $mm^2/sec$ to 1000 $mm^2/s$ and/or 50 $mm^2/sec$ to 1200 $mm^2/s$, more preferably at least 100 $mm^2/sec$, for example 100 $mm^2/sec$ to 1000 $mm^2/s$ and/or 100 $mm^2/sec$ to 1200 $mm^2/s$ and in particular 130 to 1000 $mm^2/sec$ and/or 130 $mm^2/sec$ to 1200 $mm^2/s$, in each case measured in accordance with DIN EN ISO 3104 at 40° C.

In an embodiment, the biodegradable ester is a synthetic ester. Furthermore, the ester is particularly preferably a renewable-based ester. A particularly preferred ester in an embodiment is a polyol ester, in particular (trimethylolpropane) ester, pentaerythritol ester, mixtures and/or complex esters thereof. Particularly preferred (trimethylolpropane) esters are esters of trimethylolpropane and branched or unbranched and saturated or unsaturated $C_{10}$-$C_{22}$ carboxylic acids. The acids may be monocarboxylic and/or dicarboxylic acids. If dicarboxylic acids are used, complex esters can be obtained. Particularly preferred pentaerythritol esters are esters of pentaerythritol and branched or unbranched and saturated or unsaturated $C_{10}$-$C_{22}$ carboxylic acids. Very particularly preferred esters are esters of trimethylolpropane or pentaerythritol with saturated or unsaturated branched $C_{18}$ carboxylic acids, in particular with oleic acid, isostearic acid, mixtures and/or complex esters thereof. Also particularly preferred esters are esters of trimethylolpropane with saturated or unsaturated, branched or unbranched, $C_8$-$C_{20}$ carboxylic acids, and/or $C_{10}$-$C_{22}$ carboxylic acids, in particular with sebacic acid, stearic acid and isostearic acid, mixtures and/or complex esters thereof.

Also particularly preferred esters are complex esters of trimethylolpropane with saturated, branched or unbranched, $C_8$-$C_{20}$ carboxylic acids and/or $C_{10}$-$C_{22}$ carboxylic acids, in particular with sebacic acid, stearic acid and isostearic acid, and/or mixtures thereof. Also particularly preferred esters are complex esters of trimethylolpropane with a mixture of at least two saturated or unsaturated, branched or unbranched $C_8$-$C_{20}$ carboxylic acids and/or $C_{10}$-$C_{22}$ carboxylic acids, wherein at least one first carboxylic acid is a saturated or unsaturated, branched or unbranched $C_8$-$C_{20}$ dicarboxylic acid and/or $C_{10}$-$C_{22}$ dicarboxylic acid and at least one second acid is a saturated or unsaturated, branched or unbranched $C_8$-$C_{20}$ carboxylic acid and/or $C_{10}$-$C_{22}$ carboxylic acid. Also particularly preferred esters are complex esters of trimethylolpropane with a mixture of at least two saturated, branched or unbranched $C_8$-$C_{20}$ carboxylic acids and/or $C_{10}$-$C_{22}$ carboxylic acids, wherein at least one first carboxylic acid is a saturated, unbranched $C_8$-$C_{12}$ dicarboxylic acid, in particular sebacic acid, and at least one second acid is a saturated, branched or unbranched $C_{15}$-$C_{20}$ carboxylic acid, in particular stearic acid, isostearic acid or a mixture thereof.

In an embodiment, component a) is not a triglyceride, since triglycerides have unsatisfactory hydrolytic and oxidative or chemical stability, at least for some applications.

Also suitable biodegradable base oils are polyalphaolefins and/or polyglycols.

Particularly preferred biodegradable polyalphaolefins have a viscosity measured in accordance with DIN 51562, Part 1, at 100° C. of at most 6 $mm^2/s$, for example 2 $mm^2/s$ to 6 $mm^2/s$ and/or 2 $mm^2/s$ to 5 $mm^2/s$ and/or 2 to 4 $mm^2/s$.

Particularly preferred biodegradable polyglycols are oil-soluble polyglycols. These preferably have a viscosity measured in accordance with DIN 51562, Part 1, at 40° C. of at most 150 $mm^2/s$, for example 18 $mm^2/s$ to 150 $mm^2/s$ and/or 18 $mm^2/s$ to 68 $mm^2/s$ and/or 18 to 46 $mm^2/s$.

As component b), the lubricating grease comprises a thickener selected from biodegradable calcium soaps (b1)) in an amount of 3 to 12 wt %, more preferably 4 wt % to 10 wt %, in particular 4 wt % to 7 wt %, bentonites (b2)) in an amount of 3 wt % to 25 wt % and/or 3.5 wt % to 20 wt % and/or 4 to 12 wt %, more preferably 4 wt % to 10 wt % and mixtures thereof. According to an embodiment, the proportion of thickener is 3 wt % to 25 wt % and/or 7 wt % to 20 wt %. The proportion of component b) is in each case based on the total amount of the lubricating grease.

The use of calcium soap as thickener is advantageous in that, in particular in combination with component c2), it increases the resistance to water.

A biodegradable calcium soap is to be understood in an embodiment as a calcium soap which is biodegradable according to standard OECD 301 A-F and/or OECD 306. In order for the lubricant to meet the requirements for EAL, the calcium soap must moreover have no toxicity or only minimal toxicity. Preferred calcium soaps are water-resistant, in particular they have a static water resistance in accordance with DIN 51807 T1. In an embodiment, calcium soaps are preferred to bentonites, since they have a greater thickening effect and better biodegradability. It is also possible to use mixtures of different calcium soaps or bentonites.

Calcium soaps of fatty acids, in particular C8-C26 fatty acids, in particular calcium 12-hydroxystearate, are particularly preferred.

In principle, it is also possible to use mixtures of calcium soaps and bentonites. This embodiment, however, is less preferred, at least when galvanized steel ropes are used, since zinc corrosion is impaired compared to the isolated use of calcium soaps or bentonites.

It is conceivable for the base oil to contain as component c) 1 wt % to 40 wt % additives. In an embodiment, the base oil contains 4 wt % to 40 wt %, more preferably 5 wt % to 40 wt %, more preferably 7 wt % to 40 wt %, and in particular 10 wt % to 35 wt % additives. The proportion of component c) is in each case based on the total amount of the lubricating grease.

The additives of component c) comprise, in an embodiment, 1 to 12 wt % and/or 4 to 12 wt %, preferably 4 wt % to 10 wt % fumed silicon dioxide and/or polytetrafluoroethylene as component c1). The proportion of component c1) is in each case based on the total amount of the lubricating grease.

In an embodiment, the fumed silicon dioxide is selected from silica having a specific surface area of 90 to 130 $m^2/g$. Hydrophobized fumed silica, in particular a silica hydrophobized by means of dichlorodimethylsilane, is likewise preferred.

Component c1) contributes to improving the dropping point of the lubricating grease and thereby to the temperature resistance thereof, in the sense of an increase in the upper operating temperature (UOT). In addition, component c1) has the advantage that it can act as a co-thickener and can thereby contribute to stabilizing the thickener system.

As component c2), the additives of component c) comprise, in an embodiment, a polymer selected from polyisobutylene, polyisobutylene/butene copolymer, polymethacrylates, polyesters, preferably complex esters, in particular complex esters of neopentyl glycol/dimer acid/2-ethylhexanol and mixtures thereof. A complex ester is understood in an embodiment as a polyester which is prepared by reacting polyols with dicarboxylic acids and, if appropriate, monocarboxylic acids. The proportion of component c2) is 2 wt % to 45 wt %, preferably 2 wt % to 25 wt %, more preferably 5 wt % to 20 wt %, and in particular 7 wt % to 17 wt %, in each case based on the total amount of the lubricating grease.

The polymers of component c2) preferably have a viscosity, measured in accordance with DIN 51562, Part 1, at 100° C., of at least 600 $mm^2/s$, more preferably of at least 800 $mm^2/s$ and/or at least 1000 $mm^2/s$ and/or at least 1500 $mm^2/s$ and/or at least 4000 $mm^2/s$, for example 4000 $mm^2/s$ to 10000 $mm^2/s$ and/or 4000 $mm^2/s$ to 6000 $mm^2/s$, in particular 4000 to 4700 $mm^2/s$. A high viscosity is advantageous, since in this way the amount used can be kept low. In an embodiment, polyisobutylene and/or polyisobutylene/butene copolymer is particularly preferred, since these are inexpensive raw materials and have no hydrolyzable groups, such as, for example, ester groups. Also preferred are polymers that are biodegradable.

The use of component c2) is advantageous since, as a toxicologically safe adhesion promoter, it can improve the adhesion measured in accordance with ASTM D 4049 of <50 wt % loss, for example of <30 wt % loss, more preferably of <25 wt % loss between lubricating grease and steel rope.

In an embodiment, the lubricating grease therefore preferably has a weight loss in a water spray off test in accordance with ASTM D 4049 of <50 wt % loss, for example <30 wt % loss, more preferably <25 wt %.

As component c3), the additives of component c) comprise, according to an embodiment, 0.5 wt % to 20 wt % and/or 1 wt % to 10 wt %, more preferably 1 wt % to 9 wt % and in particular 1.5 wt % to 8 wt % of a solid lubricant, preferably selected from alkaline earth metal salts, in particular calcium carbonate, calcium stearate, graphite, melamine cyanurate, zinc sulfide (ZnS), molybdenum sulfide (MoS2) and mixtures thereof. The proportion of component c3) is in each case based on the total amount of the lubricating grease.

The use of the above-mentioned solid lubricants, in particular of calcium carbonate, graphite, melamine cyanurate and calcium stearate as component c3), is particularly advantageous since these compounds are toxicologically safe and can significantly improve the frictional properties of the steel rope.

In an embodiment, less preferred solid lubricants are dithiocarbamates, in particular ashless dithiocarbamates, bis-stearoylethylenediamine and mixtures thereof. In practical experiments, it was found that the use of these compounds has a negative effect on the corrosion of the zinc layer. This is also disadvantageous from an environmental point of view, since zinc oxide, formed in the corrosion of zinc, is toxic to aquatic organisms.

It is likewise conceivable that the lubricating grease contains 0.5 wt % and in particular 0.5 to 2.8 wt % succinic acid derivatives as first corrosion inhibitor, in particular amidated succinic acid half-esters as component c4). The proportion of component c4) is in each case based on the total amount of the lubricating grease. Component c4) preferably has a total acid number (TAN) (DIN 53402) of 70 to 100 mg KOH/g.

The use of succinic acid derivatives is advantageous since they are biodegradable and have a high corrosion protection effect.

In an embodiment, the lubricating grease contains, as component c5), a second corrosion inhibitor, preferably selected from alkaline earth metal oxides, in particular calcium oxide and/or magnesium oxide, and calcium, magnesium and/or sodium sulfonates or salts of $C_8$-$C_{20}$ dicarboxylic acids, in particular disodium sebacate. An advantage of the above-mentioned components is that they offer good corrosion protection and are nontoxic. Magnesium oxide, disodium sebacate and/or mixtures thereof are particularly preferred. In a further embodiment, component c5) has a d10 particle size distribution of 1 to 10 μm, more preferably 3 to 8 μm, more preferably 4 to 6 μm and in particular 5 μm and/or a d50 particle size distribution of 10 to 30 μm, more preferably 13 to 22 μm, more preferably 15 to 20 μm and in particular 17 μm and/or a d90 particle size distribution of 30 to 50 μm, more preferably 35 to 45 μm and in particular 40 μm. In an embodiment, component c5) has a d50 particle size distribution of less than 25 μm, for example 5 μm to 25 μm and/or 5 μm to 20 μm.

The advantage of using component c5) is that it can act as a basic reserve in addition to increasing the corrosion protection of the lubricating grease. Moreover, it was found in practical experiments that magnesium oxide acts synergistically as component c5) in combination with c4).

The proportion of component c5) is preferably in the range of 0.3 to 5 wt %, more preferably 0.5 to 2.5 wt %, and in particular 1 wt % to 2.3 wt %. The proportion of component c5) is in each case based on the total amount of the lubricating grease.

Moreover, the lubricating grease can also contain other customary additives, for example antioxidants, provided that these do not have a negative effect on the environmental acceptableness of the lubricating grease. Thus, in an embodiment, the lubricating grease contains an antioxidant as component c6). This is preferably selected from nontoxic or only minimally toxic antioxidants. The proportion of the antioxidant is preferably in the range of 0.3 to 3 wt %, more preferably 0.5 to 2 wt %, and in particular 0.8 wt % to 1.5 wt %. The proportion of component c6) is in each case based on the total amount of the lubricating grease.

Particularly preferred antioxidants according to an embodiment are phenolic and/or aminic antioxidants.

In one embodiment, the lubricating grease comprises:

a) 50 wt % to 90 wt % of a biodegradable ester as base oil, b) 7 wt % to 20 wt % of a thickener selected from b1) 3 wt % to 12 wt % biodegradable calcium soap, b2) 4 wt % to 12 wt % bentonites, c) 4 wt % to 40 wt % additives, comprising c1) 4 wt % to 12 wt % fumed silicon dioxide and/or polytetrafluoroethylene and mixtures thereof, c2) 2 wt % to 25 wt % of a polymer selected from polyisobutylene, polyisobutylene/butene copolymer, polymethacrylates, complex esters of neopentyl glycol/dimer acid/2-ethylhexanol and mixtures thereof, c3) 1 wt % to 10 wt % of a solid lubricant.

In an embodiment, the lubricating grease comprises:

a) 50 wt % to 90 wt %, more preferably 60 wt % to 80 wt %, more preferably 65 wt % to 75 wt % pentaerythritol esters, in particular pentaerythritol esters of pentaerythritol and isostearic acid, as base oil, b) 3 wt % to 25 wt % of a thickener selected from b1) 3 wt % to 12 wt %, more preferably 4 wt % to 10 wt %, more preferably 4 wt % to 7 wt % Ca 12-hydroxystearate, c) 4 wt % to 40 wt %, more preferably 5 wt % to 40 wt %, more preferably 7 wt % to 40 wt %, more preferably 10 wt % to 35 wt % additives, comprising c1) 1 wt % to 12 wt % and/or 4 wt % to 12 wt %, preferably 4 wt % to 10 wt % fumed silicon dioxide, c2) 2 wt % to 45 wt % and/or 2 wt % to 25 wt %, more preferably 5 wt % to 20 wt %, and in particular 7 wt % to 17 wt % polyisobutylene, c3) 0.5 wt % to 20 wt % and/or 1 wt % to 10 wt %, more preferably 1 wt % to 9 wt %, and in particular 1.5 wt % to 8 wt % calcium carbonate as solid lubricant.

In a further embodiment, the lubricating grease comprises:

a) 50 wt % to 90 wt %, more preferably 60 wt % to 80 wt %, more preferably 65 wt % to 75 wt % pentaerythritol esters, in particular pentaerythritol esters of pentaerythritol and isostearic acid, as base oil, b) 3 wt % to 25 wt % of a thickener selected from b1) 3 wt % to 12 wt %, more preferably 4 wt % to 10 wt %, more preferably 4 wt % to 7 wt % Ca 12-hydroxystearate, c) 4 wt % to 40 wt %, more preferably 5 wt % to 40 wt %, more preferably 7 wt % to 40 wt %, more preferably 10 wt % to 35 wt % additives, comprising c1) 1 wt % to 12 wt % and/or 4 wt % to 12 wt %, preferably 4 wt % to 10 wt % fumed silicon dioxide, c2) 2 wt % to 45 wt % and/or 2 wt % to 25 wt %, more preferably 5 wt % to 20 wt %, and in particular 7 wt % to 17 wt % polyisobutylene, c3) 0.5 wt % to 20 wt % and/or 1 wt % to 10 wt %, more preferably 1 wt % to 9 wt %, and in particular 1.5 wt % to 8 wt % calcium carbonate as solid lubricant, c5) 0.3 wt % to 5 wt %, more preferably 0.5 wt % to 2.5 wt %, and in particular 1 wt % to 2.3 wt % magnesium oxide as corrosion inhibitor, c6) 0.3 wt % to 3 wt %, more preferably 0.5 wt % to 2 wt %, and in particular 0.8 wt % to 1.5 wt % of a phenolic antioxidant.

In a further embodiment, the lubricating grease comprises:

a) 50 wt % to 90 wt %, more preferably 60 wt % to 80 wt %, more preferably 65 wt % to 75 wt % complex esters, in particular complex esters of trimethylolpropane with a mixture of at least two saturated or unsaturated, branched or unbranched $C_8$-$C_{20}$ carboxylic acids, wherein at least one first carboxylic acid is a saturated or unsaturated, branched or unbranched $C_8$-$C_{20}$ dicarboxylic acid and at least one second acid is a saturated or unsaturated, branched or unbranched $C_8$-$C_{20}$ carboxylic acid, as base oil, b) 3 wt % to 25 wt % of a thickener selected from b1) 3 wt % to 12 wt %, more preferably 4 wt % to 10 wt %, more preferably 4 wt % to 7 wt % Ca 12-hydroxystearate, c) 4 wt % to 40 wt %, more preferably 5 wt % to 40 wt %, more preferably 7 wt % to 40 wt %, more preferably 10 wt % to 35 wt % additives, comprising c1) 1 wt % to 12 wt % and/or 4 wt % to 12 wt %, preferably 4 wt % to 10 wt % fumed silicon dioxide, c2) 2 wt % to 45 wt % and/or 2 wt % to 25 wt %, more preferably 5 wt % to 20 wt %, and in particular 7 wt % to 17 wt % polyisobutylene, c3) 0.5 wt % to 20 wt % and/or 1 wt % to 10 wt %, more preferably 1 wt % to 9 wt %, and in particular 1.5 wt % to 8 wt % calcium carbonate as solid lubricant.

In a further embodiment, the lubricating grease comprises:

a) 50 wt % to 90 wt %, more preferably 60 wt % to 80 wt %, more preferably 65 wt % to 75 wt % complex esters, in particular complex esters of trimethylolpropane with a mixture of at least two saturated or unsaturated, branched or unbranched $C_8$-$C_{20}$ carboxylic acids, wherein at least one first carboxylic acid is a saturated or unsaturated, branched or unbranched $C_8$-$C_{20}$ dicarboxylic acid and at least one second acid is a saturated or unsaturated, branched or unbranched $C_8$-$C_{20}$ carboxylic acid, as base oil, c) 3 wt % to 25 wt % of a thickener selected from b1) 3 wt % to 12 wt %, more preferably 4 wt % to 10 wt %, more preferably 4 wt % to 7 wt % Ca 12-hydroxystearate, c) 4 wt % to 40 wt %, more preferably 5 wt % to 40 wt %, more preferably 7 wt % to 40 wt %, more preferably 10 wt % to 35 wt % additives, comprising c1) 1 wt % to 12 wt % and/or 4 wt % to 12 wt %, preferably 4 wt % to 10 wt % fumed silicon dioxide, c2) 2 wt % to 45 wt % and/or 2 wt % to 25 wt %, more preferably 5 wt % to 20 wt %, and in particular 7 wt % to 17 wt % polyisobutylene, c3) 0.5 wt % to 20 wt % and/or 1 wt % to 10 wt %, more preferably 1 wt % to 9 wt %, and in particular 1.5 wt % to 8 wt % calcium carbonate as solid lubricant, c5) 0.3 wt % to 5 wt %, more preferably 0.5 wt % to 2.5 wt %, and in particular 1 wt % to 2.3 wt % magnesium oxide as corrosion inhibitor, c6) 0.3 wt % to 3 wt %, more preferably 0.5 wt % to 2 wt %, and in particular 0.8 wt % to 1.5 wt % of a phenolic antioxidant.

In an embodiment, disclosed is the use of the lubricating grease for coating steel ropes, in particular galvanized steel ropes. Because of their high resistance, steel ropes provided with the lubricating grease in an embodiment are outstandingly suitable for a wide variety of applications in which high-performance ropes are required, for example in the marine industry and in the oil and gas industries.

Embodiments are explained in more detail below with reference to several examples. All examples show outstanding lubricating properties when applied to steel ropes. Furthermore, they have an applicability even in the presence of water and in a wide temperature range.

Example 1: Production of a Lubricating Grease According to an Embodiment (Lubricating Grease 1)

A lubricating grease according to an embodiment is obtained by mixing components a), b1), c1), c2) and c3).

| Component | Composition | Function | Amount (wt %) |
|---|---|---|---|
| a) | Polyol ester | Base oil | 75.0 |
| b1) | Calcium 12-hydroxystearate | Thickener | 6.0 |
| c1) | Fumed silicon dioxide | Additive | 5.0 |
| c2) | Isobutylene/butene copolymer | Adhesion promoter | 11.0 |
| c3) | Calcium carbonate | Solid lubricant | 3.0 |

All components of the lubricating grease 1 according to an embodiment are biodegradable; if not biodegradable, then not bioaccumulating, and have no toxicity or only minimal toxicity. Consequently, the lubricating grease 1 according to an embodiment meets the criteria for environmentally acceptable lubricants (EAL) according to Appendix A of the 2013 Vessel General Permit.

Physical-chemical properties of Example 1 are shown in Table 1:

| Standard | Test name | Result |
|---|---|---|
| DIN ISO 2176 | Dropping point | >200° C. |
| DIN 51807 | Static water resistance | 0 |
| ASTM D 4049 | Water spray-off | <20% |
| KL-PN 010 | Zinc corrosion | <0.01% |
| DIN 58397 T1 | Evaporation loss | <5% |

Example 2: Production of a Lubricating Grease According to an Embodiment (Lubricating Grease 2)

A lubricating grease according to an embodiment is obtained by mixing components a), b1), c1), c2), c3), c5) and c6).

| Component | Composition | Function | Amount (wt %) |
|---|---|---|---|
| a) | Polyol ester | Base oil | 70.0 |
| b1) | Calcium 12-hydroxystearate | Thickener | 5.5 |
| c1) | Fumed silicon dioxide | Additive | 4.0 |
| c2) | Isobutylene/butene copolymer | Adhesion promoter | 15.0 |
| c3) | Calcium carbonate | Solid lubricant | 2.0 |
| c5) | Magnesium oxide | Corrosion protection | 2.5 |
| c6) | Phenolic antioxidant | Antioxidant | 1.0 |

The components of the lubricating grease 2 according to an embodiment are also biodegradable; if not biodegradable, then not bioaccumulating, and have no toxicity or only minimal toxicity. Consequently, the lubricating grease 1 according to an embodiment meets the criteria for environmentally acceptable lubricants (EAL) according to Appendix A of the 2013 Vessel General Permit.

Physical-chemical properties of Example 2 are shown in Table 2:

| Standard | Test name | Result |
|---|---|---|
| DIN ISO 2176 | Dropping point | >200° C. |
| DIN 51807 | Static water resistance | 0 |
| ASTM D 4049 | Water spray-off | <20% |
| KL-PN 010 | Zinc corrosion | <0.01% |
| DIN 58397 T1 | Evaporation loss | <5% |

Example 3: Production of a Lubricating Grease According to an Embodiment (Lubricating Grease 3)

A lubricating grease according to an embodiment is obtained by mixing components a), b1), b2), c1), c2) and c3).

| Component | Composition | Function | Amount (wt %) |
|---|---|---|---|
| a) | Polyol ester | Base oil | 68.0 |
| b1)(b3) | Calcium 12-hydroxystearate | Thickener | 5.0 |
| b2)(b3) | Bentonite | Thickener | 4.0 |
| c1) | Fumed silicon dioxide | Additive | 4.0 |
| c2) | Isobutylene/butene copolymer | Adhesion promoter | 6.0 |
| c2) | Complex esters | Adhesion promoter | 10.0 |
| c3) | Zinc sulfide | Solid lubricant | 3.0 |

The components of the lubricating grease 3 according to an embodiment are also biodegradable; if not biodegradable, then not bioaccumulating, and have no toxicity or only minimal toxicity. Consequently, the lubricating grease 3 according to an embodiment meets the criteria for environmentally acceptable lubricants (EAL) according to Appendix A of the 2013 Vessel General Permit.

Physical-chemical properties of Example 3 are shown in Table 3:

| Standard | Test name | Result |
|---|---|---|
| DIN ISO 2176 | Dropping point | >200° C. |
| DIN 51807 | Static water resistance | 0 |
| ASTM D 4049 | Water spray-off | <10% |
| KL-PN 010 | Zinc corrosion | <0.05% |
| DIN 58397 T1 | Evaporation loss | <5% |

Example 4: Production of a Lubricating Grease According to an Embodiment (Lubricating Grease 4)

A lubricating grease according to an embodiment is obtained by mixing components a), b1), b2), c1), c2) and c3).

| Component | Composition | Function | Amount (wt %) |
|---|---|---|---|
| a) | Polyol ester | Base oil | 71.0 |
| b1)(b3) | Calcium 12-hydroxystearate | Thickener | 5.0 |
| b2)(b3) | Bentonite | Thickener | 3.0 |
| c1) | Fumed silicon dioxide | Additive | 4.0 |

-continued

| Component | Composition | Function | Amount (wt %) |
|---|---|---|---|
| c2) | Isobutylene/butene copolymer | Adhesion promoter | 9.0 |
| c2) | Polymethacrylate | Adhesion promoter | 4.0 |
| c3) | Zinc sulfide | Solid lubricant | 4.0 |

The components of the lubricating grease 4 according to an embodiment are also biodegradable; if not biodegradable, then not bioaccumulating, and have no toxicity or only minimal toxicity. Consequently, the lubricating grease 4 according to an embodiment meets the criteria for environmentally acceptable lubricants (EAL) according to Appendix A of the 2013 Vessel General Permit.

Physical-chemical properties of Example 4 are shown in Table 4:

| Standard | Test name | Result |
|---|---|---|
| DIN ISO 2176 | Dropping point | >200° C. |
| DIN 51807 | Static water resistance | 0 |
| ASTM D 4049 | Water spray-off | <10% (7%) |
| KL-PN 010 | Zinc corrosion | <0.1% (0.06%) |
| DIN 58397 T1 | Evaporation loss | <5% |

Example 5: Production of a Lubricating Grease According to an Embodiment (Lubricating Grease 5)

A lubricating grease according to an embodiment is obtained by mixing components a), b1), c1), c2) and c3).

| Component | Composition | Function | Amount (wt %) |
|---|---|---|---|
| a) | Polyol ester | Base oil | 75 |
| b1) | Calcium 12-hydroxystearate | Thickener | 4 |
| c1) | Fumed silicon dioxide | Additive | 6.0 |
| c2) | Isobutylene/butene copolymer | Adhesion promoter | 8.0 |
| c2) | Polymethacrylate | Adhesion promoter | 2.0 |
| c2) | Complex esters | Adhesion promoter | 3.0 |
| c3) | Zinc sulfide | Solid lubricant | 2.0 |

The components of the lubricating grease 5 according to an embodiment are also biodegradable; if not biodegradable, then not bioaccumulating, and have no toxicity or only minimal toxicity. Consequently, the lubricating grease 5 according to an embodiment meets the criteria for environmentally acceptable lubricants (EAL) according to Appendix A of the 2013 Vessel General Permit.

Physical-chemical properties of Example 5 are shown in Table 5:

| Standard | Test name | Result |
|---|---|---|
| DIN ISO 2176 | Dropping point | >200° C. |
| DIN 51807 | Static water resistance | 1 |
| ASTM D 4049 | Water spray-off | <30% |
| KL-PN 010 | Zinc corrosion | <0.02% |
| DIN 58397 T1 | Evaporation loss | <5% |

Example 6: Production of a Lubricating Grease According to an Embodiment (Lubricating Grease 6)

A lubricating grease according to an embodiment is obtained by mixing components a), b1), b2), c1), c2), c3), c4), c5) and c6).

| Component | Composition | Function | Amount (wt %) |
|---|---|---|---|
| a) | Polyol ester | Base oil | 64.0 |
| b1)(b3) | Calcium 12-hydroxystearate | Thickener | 4.0 |
| b2)(b3) | Bentonite | Thickener | 7.0 |
| c1) | Fumed silicon dioxide | Additive | 4.0 |
| c2) | Isobutylene/butene copolymer | Adhesion promoter | 10.0 |
| c3) | Calcium stearate | Solid lubricant | 7.0 |
| c4) | Succinic acid derivative | Corrosion protection | 2.0 |
| c5) | Magnesium oxide | Corrosion protection | 1.0 |
| c6) | Phenolic antioxidant | Antioxidant | 1.0 |

The components of the lubricating grease 6 according to an embodiment are also biodegradable; if not biodegradable, then not bioaccumulating, and have no toxicity or only minimal toxicity. Consequently, the lubricating grease 6 according to an embodiment meets the criteria for environmentally acceptable lubricants (EAL) according to Appendix A of the 2013 Vessel General Permit.

Physical-chemical properties of Example 6 are shown in Table 6:

| Standard | Test name | Result |
|---|---|---|
| DIN ISO 2176 | Dropping point | >200° C. |
| DIN 51807 | Static water resistance | 0 |
| ASTM D 4049 | Water spray-off | <10% |
| KL-PN 010 | Zinc corrosion | <0.1% |
| DIN 58397 T1 | Evaporation loss | <5% |

Example 7: Production of a Lubricating Grease According to an Embodiment (Lubricating Grease 7)

A lubricating grease according to an embodiment is obtained by mixing components a), b2), c1), c2), c3), c5) and c6).

| Component | Composition | Function | Amount (wt %) |
|---|---|---|---|
| a) | Pentaerythritol ester | Base oil | 71.0 |
| b2) | Bentonite | Thickener | 12.0 |
| c1) | Fumed silicon dioxide | Additive | 2.0 |
| c2) | Complex esters | Adhesion promoter | 4.0 |
| c2) | Polymethacrylate | Adhesion promoter | 3.0 |
| c3) | Calcium stearate | Solid lubricant | 5.0 |
| c5) | Magnesium oxide | Corrosion protection | 2.0 |
| c6) | Phenolic antioxidant | Antioxidant | 1.0 |

The components of the lubricating grease 7 according to an embodiment are also biodegradable; if not biodegradable, then not bioaccumulating, and have no toxicity or only minimal toxicity. Moreover, the lubricating grease 7 according to an embodiment meets the criteria for environmentally acceptable lubricants (EAL) according to Appendix A of the 2013 Vessel General Permit.

Physical-chemical properties of Example 7 are shown in Table 7:

| Standard | Test name | Result |
|---|---|---|
| DIN ISO 2176 | Dropping point | >200° C. |
| DIN 51807 | Static water resistance | 1 |
| ASTM D 4049 | Water spray-off | <20% |
| KL-PN 010 | Zinc corrosion | <0.05% |
| DIN 58397 T1 | Evaporation loss | <5% |

Example 8: Production of a Lubricating Grease According to an Embodiment (Lubricating Grease 8)

A lubricating grease according to an embodiment is obtained by mixing components a), b1), c1), c2), c3), c5) and c6).

| Component | Composition | Function | Amount (wt %) |
|---|---|---|---|
| a) | Pentaerythritol esters of pentaerythritol and isostearic acid | Base oil | 70.0 |
| b1) | Ca 12-hydroxystearate | Thickener | 6.0 |
| c1) | Fumed silicon dioxide | Additive | 6.0 |
| c2) | Polyisobutylene | Adhesion promoter | 13.0 |
| c3) | Calcium carbonate | Solid lubricant | 2.0 |
| c5) | Magnesium oxide | Corrosion protection | 2.0 |
| c6) | Phenolic antioxidant | Antioxidant | 1.0 |

The components of the lubricating grease 8 according to an embodiment are also biodegradable; if not biodegradable, then not bioaccumulating, and have no toxicity or only minimal toxicity. Moreover, the lubricating grease 8 according to an embodiment meets the criteria for environmentally acceptable lubricants (EAL) according to Appendix A of the 2013 Vessel General Permit.

Physical-chemical properties of Example 8 are shown in Table 8:

| Standard | Test name | Result |
|---|---|---|
| DIN ISO 2176 | Dropping point | >200° C. |
| DIN 51807 | Static water resistance | 0 |
| ASTM D 4049 | Water spray-off | <10% |
| KL-PN 010 | Zinc corrosion | <0.01% |
| DIN 58397 T1 | Evaporation loss | <5% |

Example 9: Production of a Lubricating Grease According to an Embodiment (Lubricating Grease 9)

A lubricating grease according to an embodiment is obtained by mixing components a), b1), c1), c2), c3), c5) and c6).

| Component | Composition | Function | Amount (wt %) |
|---|---|---|---|
| a) | Complex esters based on trimethylolpropane, Sebacic acid, stearic acid and isostearic acid | Base oil | 70.0 |
| b1) | Ca 12-hydroxystearate | Thickener | 7.0 |
| c1) | Fumed silicon dioxide | Additive | 5.0 |
| c2) | Polyisobutylene | Adhesion promoter | 11.0 |
| c3) | Calcium carbonate | Solid lubricant | 4.0 |
| c5) | Magnesium oxide | Corrosion protection | 2.0 |
| c6) | Phenolic antioxidant | Antioxidant | 1.0 |

The components of the lubricating grease 9 according to an embodiment are also biodegradable; if not biodegradable, then not bioaccumulating, and have no toxicity or only minimal toxicity. Moreover, the lubricating grease 9 according to an embodiment meets the criteria for environmentally acceptable lubricants (EAL) according to Appendix A of the 2013 Vessel General Permit.

Physical-chemical properties of Example 9 are shown in Table 9:

| Standard | Test name | Result |
|---|---|---|
| DIN ISO 2176 | Dropping point | >200° C. |
| DIN 51807 | Static water resistance | 0 |
| ASTM D 4049 | Water spray-off | <5% |
| KL-PN 010 | Zinc corrosion | <0.01% |
| DIN 58397 T1 | Evaporation loss | <5% |

Example 10: Production of a Lubricating Grease According to an Embodiment (Lubricating Grease 10)

A lubricating grease according to an embodiment is obtained by mixing components a), b1), c1), c2), c3), c5) and c6).

| Component | Composition | Function | Amount (wt %) |
|---|---|---|---|
| a) | Oil-soluble polyglycol | Base oil | 68.0 |
| b1) | Ca 12-hydroxystearate | Thickener | 8.0 |
| c1) | Fumed silicon dioxide | Additive | 5.0 |
| c2) | Polyisobutylene | Adhesion promoter | 14.0 |
| c3) | Calcium carbonate | Solid lubricant | 2.0 |
| c5) | Magnesium oxide | Corrosion protection | 2.0 |
| c6) | Phenolic antioxidant | Antioxidant | 1.0 |

The components of the lubricating grease 10 according to an embodiment are also biodegradable; if not biodegradable, then not bioaccumulating, and have no toxicity or only minimal toxicity. Moreover, the lubricating grease 10 according to an embodiment meets the criteria for environmentally acceptable lubricants (EAL) according to Appendix A of the 2013 Vessel General Permit.

Physical-chemical properties of Example 10 are shown in Table 10:

| Standard | Test name | Result |
|---|---|---|
| DIN ISO 2176 | Dropping point | ≥150° C. |
| DIN 51807 | Static water resistance | 0 |

-continued

| Standard | Test name | Result |
|---|---|---|
| ASTM D 4049 | Water spray-off | <65% |
| KL-PN 010 | Zinc corrosion | <0.0005% |

Example 11: Production of a Lubricating Grease According to an Embodiment (Lubricating Grease 11)

A lubricating grease according to an embodiment is obtained by mixing components a), b2), c1), c2), c3), c5) and c6).

| Component | Composition | Function | Amount (wt %) |
|---|---|---|---|
| a) | Polyol ester | Base oil | 70.0 |
| b2) | Bentonite | Thickener | 18.0 |
| c1) | Polytetrafluoroethylene | Additive | 1.0 |
| c2) | Polyisobutylene | Adhesion promoter | 2.0 |
| c3) | Calcium stearate | Solid lubricant | 6.0 |
| c5) | Magnesium oxide | Corrosion protection | 2.0 |
| c6) | Phenolic antioxidant | Antioxidant | 1.0 |

The components of the lubricating grease 11 according to an embodiment are also biodegradable; if not biodegradable, then not bioaccumulating, and have no toxicity or only minimal toxicity. Moreover, the lubricating grease 11 according to an embodiment meets the criteria for environmentally acceptable lubricants (EAL) according to Appendix A of the 2013 Vessel General Permit.

Physical-chemical properties of Example 11 are shown in Table 11:

| Standard | Test name | Result |
|---|---|---|
| DIN ISO 2176 | Dropping point | ≥200° C. |
| DIN 51807 | Static water resistance | 1 |
| ASTM D 4049 | Water spray-off | <15% |
| KL-PN 010 | Zinc corrosion | <0.05% |
| DIN 58397 T1 | Evaporation loss | <10% |

Example 12: Production of a Lubricating Grease According to an Embodiment (Lubricating Grease 12)

A lubricating grease according to an embodiment is obtained by mixing components a), b1), c1), c2), c3), c5) and c6).

| Component | Composition | Function | Amount (wt %) |
|---|---|---|---|
| a) | Polyol ester | Base oil | 70.0 |
| b1) | Ca 12-hydroxystearate | Thickener | 7.0 |
| c1) | Fumed silicon dioxide | Additive | 1.0 |
| c2) | Polyisobutylene | Adhesion promoter | 17.0 |
| c3) | Calcium stearate | Solid lubricant | 2.0 |
| c5) | Magnesium oxide | Corrosion protection | 2.0 |
| c6) | Phenolic antioxidant | Antioxidant | 1.0 |

The components of the lubricating grease 12 according to an embodiment are also biodegradable; if not biodegradable, then not bioaccumulating, and have no toxicity or only minimal toxicity. Moreover, the lubricating grease 12 according to an embodiment meets the criteria for environmentally acceptable lubricants (EAL) according to Appendix A of the 2013 Vessel General Permit.

Physical-chemical properties of Example 12 are shown in Table 12:

| Standard | Test name | Result |
|---|---|---|
| DIN ISO 2176 | Dropping point | ≥150° C. |
| DIN 51807 | Static water resistance | 0 |
| ASTM D 4049 | Water spray-off | <20% |
| KL-PN 010 | Zinc corrosion | <0.005% |
| DIN 58397 T1 | Evaporation loss | <5% |

Example 13: Production of a Lubricating Grease According to an Embodiment (Lubricating Grease 13)

A lubricating grease according to an embodiment is obtained by mixing components a), b1), c1), c2), c3), c5) and c6).

| Component | Composition | Function | Amount (wt %) |
|---|---|---|---|
| a) | Polyol ester | Base oil | 60.0 |
| b1) | Ca 12-hydroxystearate | Thickener | 3.0 |
| c1) | Fumed silicon dioxide | Additive | 8.0 |
| c1) | Polytetrafluoroethylene | Additive | 4.0 |
| c2) | Polyisobutylene | Adhesion promoter | 5.0 |
| c3) | Calcium stearate | Solid lubricant | 17.0 |
| c5) | Magnesium oxide | Corrosion protection | 2.0 |
| c6) | Phenolic antioxidant | Antioxidant | 1.0 |

The components of the lubricating grease 13 according to an embodiment are also biodegradable; if not biodegradable, then not bioaccumulating, and have no toxicity or only minimal toxicity. Moreover, the lubricating grease 13 according to an embodiment meets the criteria for environmentally acceptable lubricants (EAL) according to Appendix A of the 2013 Vessel General Permit.

Physical-chemical properties of Example 13 are shown in Table 13:

| Standard | Test name | Result |
|---|---|---|
| DIN ISO 2176 | Dropping point | ≥150° C. |
| DIN 51807 | Static water resistance | 0 |
| ASTM D 4049 | Water spray-off | <20% |
| KL-PN 010 | Zinc corrosion | <0.02% |
| DIN 58397 T1 | Evaporation loss | <5% |

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An environmentally acceptable lubricating grease, comprising:

a) 50 wt % to 90 wt % of a biodegradable base oil comprising a biodegradable ester as base oil, b) 3 wt % to 25 wt % of a thickener selected from b1) 3 wt % to 12 wt % biodegradable calcium soap, b2) 3 wt % to 25 wt % bentonites, b3) and mixtures thereof, and c) 4 wt % to 40 wt % additives, comprising c1) 1 wt % to 12 wt % fumed silicon dioxide and/or polytetrafluoroethylene and/or mixtures thereof, c2) 2 wt % to 45 wt % of a polymer selected from polyisobutylene, polyisobutylene/butene copolymer, polymethacrylates, polyesters and mixtures thereof, c3) 0.5 wt % to 20 wt % of a solid lubricant, wherein the lubricating grease and/or the ester a) has a thermal stability, determinable via TGA DIN 51006 of 150° C. to 200° C. and/or a volatility measured according to DIN 58397 of <10 wt % and/or a TAN Delta measured in accordance with DIN ASTM D-2619 with extended running time of 400 h of 0.0 mg KOH/g to 20 mg KOH/g and/or an acid content (TAN) of less than 5 mg KOH/g.

2. The lubricating grease according to claim 1, wherein a dropping point according to standard DIN ISO 2176 is over 150° C.

3. The lubricating grease according to claim 1, wherein an upper operating temperature (UOT) according to standard DIN 58397, Part 1, is at least 150° C.

4. The lubricating grease according to claim 1, wherein the viscosity of the ester a) is at least 50 $mm^2$/sec as measured in accordance with DIN EN ISO 3104 at 40° C.

5. The lubricating grease according to claim 1, wherein the biodegradable calcium soap b1) is selected from calcium soaps of fatty acids comprising calcium 12-hydroxystearate.

6. The lubricating grease according to claim 1, wherein the fumed silicon dioxide c1) is selected from silica having a specific surface area of 90 to 130 $m^2$/g.

7. The lubricating grease according to claim 1, wherein the polymers of component c2) have a viscosity measured in accordance with DIN 51562, Part 1, at 100° C. of at least 600 $mm^2$/s.

8. The lubricating grease according to claim 1, further comprising as component c5) a corrosion inhibitor selected from alkaline earth metal oxides comprising calcium oxide and/or magnesium oxide, and calcium, magnesium and/or sodium sulfonates or salts of $C_8$-$C_{20}$ dicarboxylic acids comprising disodium sebacate.

9. A method, comprising coating steel ropes comprising galvanized steel ropes with the lubricating grease according to claim 1.

10. The lubricating grease according to claim 1, comprising 7 wt % to 20 wt % of the thickener b).

11. The lubricating grease according to claim 1, wherein the thickener b) is selected from:

b1) 3 wt % to 12 wt % biodegradable calcium soap, b2) 3.5 wt % to 20 wt % bentonites, b3) and mixtures thereof.

12. The lubricating grease according to claim 1, wherein the thickener b) is selected from:

b1) 3 wt % to 12 wt % biodegradable calcium soap, b2) 4 wt % to 12 wt % bentonites, b3) and mixtures thereof.

13. The lubricating grease according to claim 1, comprising 7 wt % to 40 wt % of the additives c).

14. The lubricating grease according to claim 1, wherein the additives c) comprises 4 wt % to 12 wt % fumed silicon dioxide and/or polytetrafluoroethylene and/or mixtures thereof.

15. The lubricating grease according to claim 1, wherein the additives c) comprises 2 wt % to 25 wt % of the polymer c2).

16. The lubricating grease according to claim 1, wherein the polymer c2) comprises polyesters comprising complex esters of neopentyl glycol/dimer acid/2-ethylhexanol.

17. The lubricating grease according to claim 1, wherein the additives c) comprises 1 wt % to 10 wt % of the solid lubricant c3).

18. The lubricating grease according to claim 1, wherein the lubricating grease and/or the ester a) has a volatility measured according to DIN 58397 of <5 wt %.

19. The lubricating grease according to claim 7, wherein the polymers of component c2) have a viscosity measured in accordance with DIN 51562, Part 1, at 100° C. of at least 4000 $mm^2$/s.

20. The lubricating grease according to claim 8, wherein the component c5) comprises an alkaline earth metal oxide comprising calcium oxide and/or magnesium oxide.

* * * * *